United States Patent [19]

Yoshida et al.

[11] 4,137,883

[45] Feb. 6, 1979

[54] DEVICE FOR SUPPRESSING DISTURBANCE ELECTRIC WAVE FOR MOTORCYCLES

[75] Inventors: Mitsutaka Yoshida, Chita; Toshikazu Kawakami, Kamifukuoka, both of Japan

[73] Assignees: Honda Giken Kogyo Kabushiki Kaisha, Tokyo; NGK Spark Plug Co., Ltd., Nagoya, both of Japan

[21] Appl. No.: 835,134

[22] Filed: Sep. 21, 1977

[30] Foreign Application Priority Data

Oct. 6, 1976 [JP] Japan ..... 51-119270

[51] Int. Cl.[2] ..... F02P 1/00

[52] U.S. Cl. ..... 123/148 P

[58] Field of Search ..... 123/148 P, 148 R, 148 D, 123/148 DC

[56] References Cited

U.S. PATENT DOCUMENTS

| | | | |
|---|---|---|---|
| 2,491,156 | 12/1949 | Bohn | 123/148 P X |
| 2,675,415 | 4/1954 | Cushman | 123/148 P |

*Primary Examiner*—Alan Cohan

*Attorney, Agent, or Firm*—Stevens, Davis, Miller & Mosher

[57] ABSTRACT

A device for suppressing disturbance electric wave for motorcycles is disclosed. The device makes use of a flexible wire for connecting a ground terminal of a secondary winding of an ignition coil to a ground terminal of an ignition plug.

9 Claims, 12 Drawing Figures

DEVICE FOR SUPPRESSING DISTURBANCE ELECTRIC WAVE FOR MOTORCYCLES

BACKGROUND OF THE INVENTION

This invention relates to a device for suppressing a disturbance electric wave for motorcycles which can effectively suppress a radiation disturbance electric wave mainly produced due to a spark discharge of an ignition plug of a spark ignition type gasoline engine mounted on a motorcycle.

A motorcycle provided with an internal combustion engine, particularly a spark ignition type gasoline engine tends to radiate a disturbance electric wave having a radio frequency toward outside. It has recently become important to prevent such disturbance electric wave and regulation of the disturbance electric wave now becomes strengthened.

Many attempts have been made to prevent the disturbance electric wave by using an ignition plug with a resistor incorporated therein, an ignition plug cap with a resistor or an inductor incorporated therein, a shield cord, a shield cap, a distribution resistor high tension cord, etc., but hitherto none has led to fully satisfactory results. In addition, it is difficult to stabilize the disturbance electric wave to a value within upper limit allowable on the basis of Europe Standard (C.I.S.P.R.) or SAE Standard by taking deviation from the standard ignition device, etc. in mass production scale into consideration. In addition, the conventional supressing device is expensive.

SUMMARY OF THE INVENTION

An object of the invention, therefore, is to provide a device for suppressing a disturbance electric wave for motorcycles, which can easily applicable to existing motorcycles, can suppress generation of the radiation disturbance electric wave in a simple and reliable manner and which is less expensive.

Experimental tests have yielded the surprising result that a high voltage circuit of an ignition plug is not influential in generation of the disturbance electric wave, but a ground circuit including a frame of a motorcycle is much influential in generation of the disturbance electric wave. The invention is based on such recognition and provides a novel device for suppressing the disturbance electric wave for motorcycles.

DESCRIPTION OF THE PREFERRED EMBODIMENTS

Before describing the invention, generation of disturbance electric wave due to spark discharge of an ignition plug for motorcycles will now be described with reference to FIG. 1.

Figure 1:
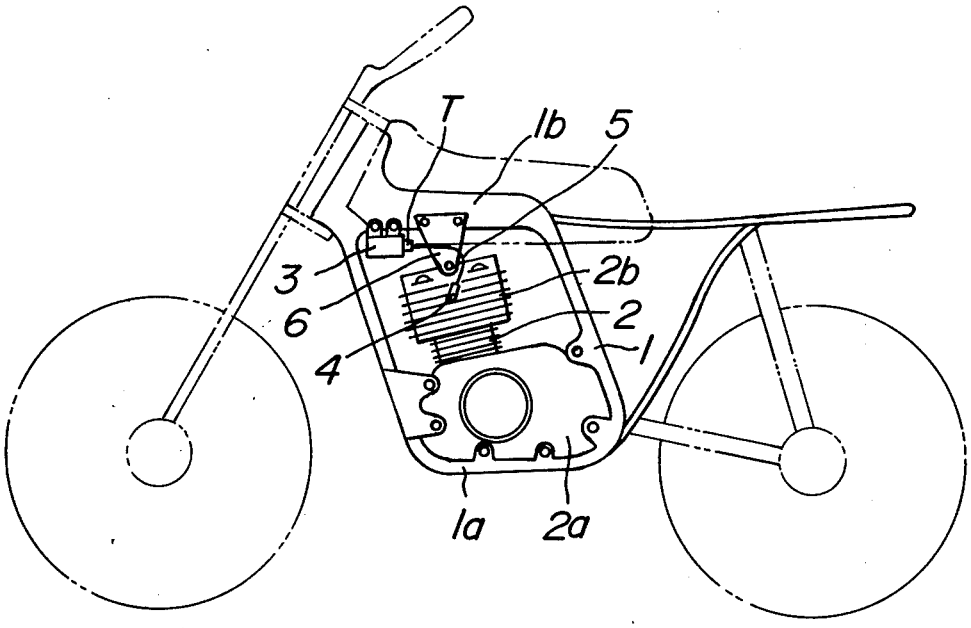
FIG. 1 PRIOR ART
FIG. 1 is a diagrammatic front elevational view of a motorcycle provided with a prior art ignition device.

In FIG. 1 is shown a motorcycle comprising a frame 1 provided thereon with an engine 2 and an ignition coil 3. The engine 2 is composed of a crank case 2*a* firmly secured to a base 1*a* of the frame 1 and made electrically conductive thereto and a combustion chamber 2*b* having a height which is about half the total height of the engine 2 and extending in a direction substantially perpendicular thereto up to near a top 1*b* of the frame 1. The ignition coil 3 is usually secured to a lower side of the top 1*b* of the frame 1 and provided at its secondary side with a high voltage terminal T connected through a high voltage cord 5 which is relatively short in length to an ignition plug 4 mounted on a head of the combustion chamber 2*b*, that is, a cylinder head.

In FIG. 1, reference numeral 6 designates a stay secured to the top 1*b* of the frame 1 and projecting downwardly. The stay 6 is adapted to support a top of the combustion chamber 2*b* through an antioscillation rubber cushion for the purpose of absorbing oscillations of the engine 2. As a result, the frame 1 is not electrically conductive to the combustion chamber 2*b* or is connected thereto under an incomplete electrical conductive state. Eventually, such stay 6 may be omitted.

In the above described ignition coil 3 for motorcycles, its secondary coil is connected through the frame 1 to ground.

Figure 2:
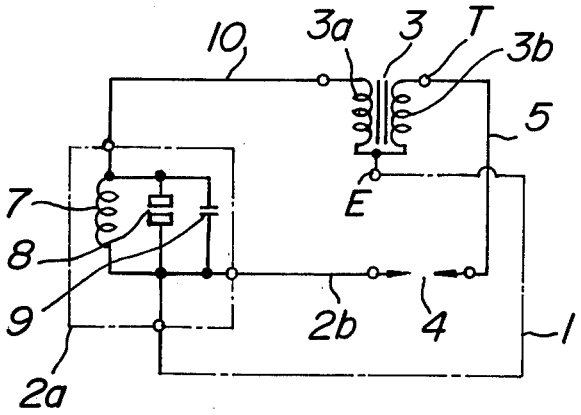
FIG. 2 PRIOR ART
FIGS. 2 and 3 are two simplified illustrations of a prior art ground circuit of the ignition device shown in FIG. 1.

In FIG. 2 is shown a ground connection circuit for a magneto generator type ignition device in which use is made of a low voltage produced by a magneto generator as an electric source for the primary coil. Such ground connection circuit may also be used for a condenser discharge ignition device.

In FIG. 2, reference numeral 1 designates a frame, 2*a* an engine crank case, 2*b* an engine combustion chamber and 3 an ignition coil, these parts corresponding to those shown in FIG. 1. Reference numeral 3*a* shows a primary coil of the ignition coil 3 and 3*b* illustrates a secondary coil thereof. 4 is an ignition plug, 5 a high voltage cord, 7 a coil for a magneto generator mounted on the crank case 2*a* of the engine 1, 8 a contact point connected in parallel with the coil 7, 9 a condenser connected also in parallel with the coil 7, and 10 a low voltage lead wire for connecting the coil 7 to the primary coil 3*a* of the ignition coil 3 and usually arranged along the frame 1.

In the ignition device shown in FIG. 2, a ground connection circuit of the secondary coil 3*b* of the ignition coil 3 is completed from a ground terminal E common to both the primary and secondary coils 3*a*, 3*b* of the ignition coil 3 through the frame 1, crank case 2*a* and combustion chamber 2*b* to the ignition plug 4.

Figure 3:
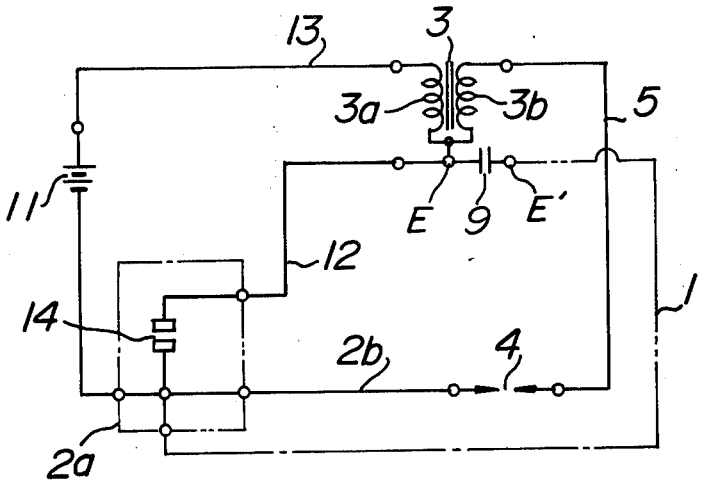
FIG 3 PRIOR ART

In FIG. 3 is shown another prior art ignition device which comprises a breaker point 14 and its arc-suppressing condenser 9 and in which a common ground terminal E of an ignition coil 3 is connected through the breaker point 14 or the arc-suppressing condenser 9 to ground and use is made of a battery 11 as an electric source for the primary coil 3*a*. That is, the ground terminal E of the ignition coil 3 is connected through a lead wire 12 to the breaker point 14 on the one hand and connected to one end of a condenser 9 arranged near the ignition coil 3 on the other hand, another end E' of the condenser 9 being connected to the frame 1.

In the representative prior art ignition devices shown in FIGS. 2 and 3, the ground circuit connected to the ground terminal E common to the primary and secondary coils 3*a*, 3*b* of the ignition coil 3 includes the frame 1 as its constitutional element. As a result, it is possible to cause the frame 1 to operate as a secondary body for radiating a disturbance electric wave in dependence with incompleteness of electric connection between the frame 1 and the ignition plug 4 which functions as a high frequency disturbance electric wave generation source. However, hitherto none has led to effective suppression of such radiating disturbance electric wave.

In accordance with the invention, the ignition coil 3 is secured to that portion of the frame 1 which is located near the ignition plug 4 secured to the top of the combustion chamber 2*b* of the engine 2 mounted on the frame 1, for example, to the upper frame portion 1*b*. The ignition coil 3 is provided at its ground side of the secondary coil 3*b* or at that portion of the frame 1 which is substantially the same potential as that of the ground side of the secondary coil 3*b* with a ground terminal E. The ground terminal E is electrically connected through a flexible wire 15 to the top of the combustion chamber 2*b* of the engine 2. The inventors have found out that the use of the measures as described below ensures complete suppression of propagation of the radiation disturbance electric wave.

Figure 4:
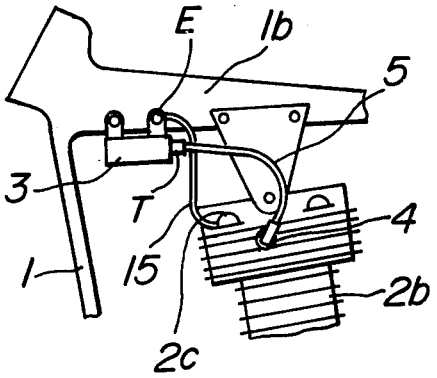
FIG. 4 is a diagrammatic front elevational view of a motorcycle provided with an ignition device that may be employed to practice the present invention.

In FIG. 4 is shown main parts of one embodiment of an ignition device for motorcycles according to the invention. In the present embodiment, the above mentioned flexible wire 15 is composed of a bonding strap formed of a copper braid having a width of 8 mm and a length of 20 cm and the ignition coil 3 is secured to the frame 1 by means of a screw formed of the ground terminal E. The ground side of the secondary coil 3*b* of the ignition coil 3 is directly connected through such short flexible wire 15 to the top portion of the combustion chamber 2*b*. In this case, one end of the flexible wire 15 is secured to the frame 1 by means of the ground terminal E and the other end thereof is secured to the top portion of the combustion chamber 2*b* by means of a screw 2*c*.

Figure 5A:
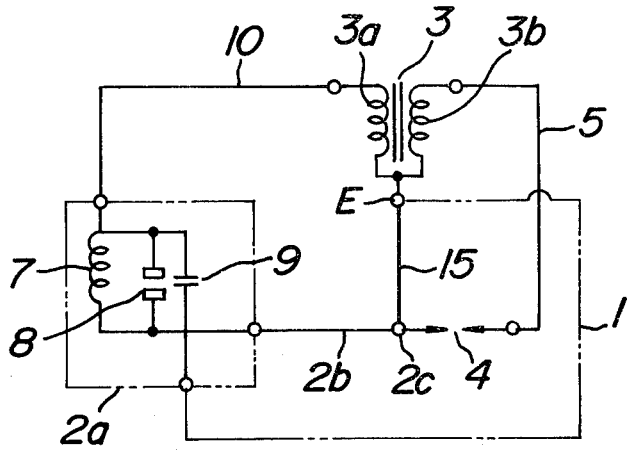
FIGS. 5*a*, 5*b*, 6*a* and 6*b* are four simplified illustrations of a ground circuit of the ignition device shown in FIG. 4.

In FIG. 5*a* is shown one embodiment of an electric circuit for an ignition device according to the invention. In the present embodiment, the prior art electric circuit shown in FIG. 2 is modified such that the ground circuit of a secondary coil 3*b* of an ignition coil 3 is completed from a ground terminal E of the ignition coil 3 for connecting the ignition coil 3 to the frame 1 through a bonding strap 15 to a ground side of an ignition plug 4.

Figure 5B:
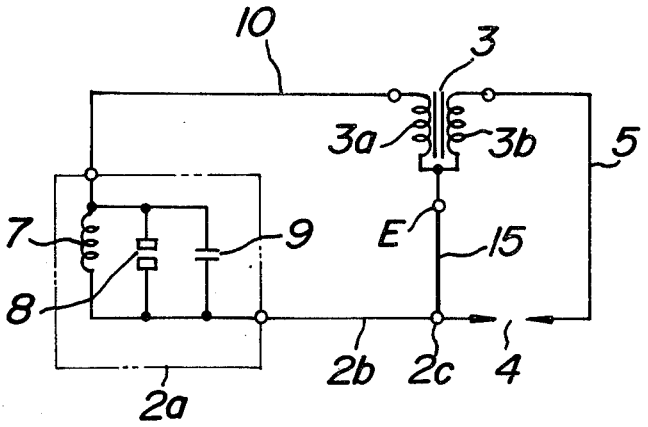

In FIG. 5*b* is shown a modified embodiment of the electric circuit shown in FIG. 5*a*. In the present embodiment, the ignition coil 3 is secured to the frame 1 under an insulated condition so as to substantially interrupt a ground current flowing through the frame 1. As a result, the ground circuit of the secondary side of the ignition coil 3 is formed by the bonding strap 15 only.

Figure 6A:
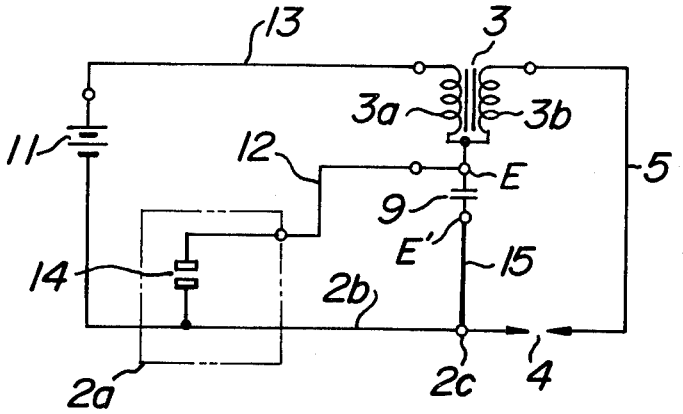

In FIG. 6*a* is shown a further embodiment of an electric circuit of an ignition device according to the invention. In the present embodiment, the prior art electric circuit shown in FIG. 3 is modified such that the ground terminal E' of the condenser 9 connected to the ground terminal E common to both the primary and secondary coils 3*a*, 3*b* of the ignition coil 3 is directly connected through the bonding strap 15 to the screw 2*c* for securing the bonding strap 15 to the top of the combustion chamber 2*b*.

Figure 6B:
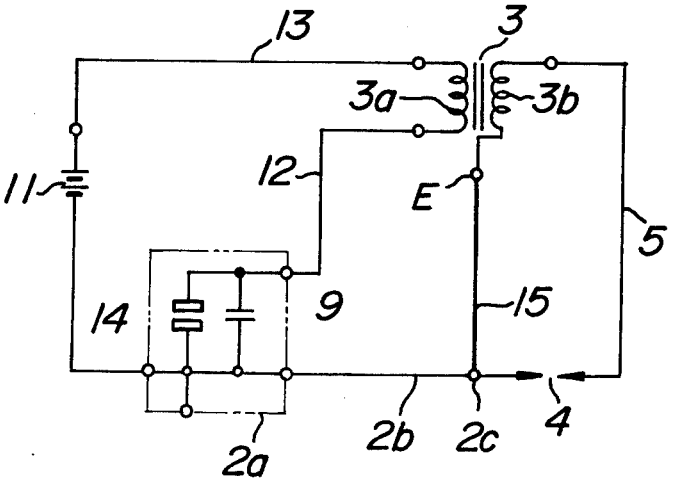

In FIG. 6*b* is shown a modified embodiment of the ignition device shown in FIG. 6*a*. In the present embodiment, the ground side of the primary coil 3*a* of the ignition coil 3 is made independent of the ground side of the secondary coil 3*b* and is connected through a lead wire 12 to the breaker point 14 and arc-suppressing condenser 9. The ground terminal E of the secondary coil 3*b* of the ignition coil 3 is connected through the bonding strap 15 to the screw 2*c* secured to the top portion of the combustion chamber 2*b*.

In the embodiments shown in FIGS. 5*b* and 6*b*, it is preferable to use a conductor having a high resistivity instead of the bonding strap 15 as the flexible wire for the purpose of utilizing an attenuation property of such conductor.

In FIGS. 7 to 10 are shown curves of noise electric field intensity (dB) as function of a frequency (MHz) as measured by testing the ignition devices shown in FIGS. 2, 3 and 5, 6 under condition shown in the following Table and as compared with those of the prior art ignition devices.

Table

Figure 7:
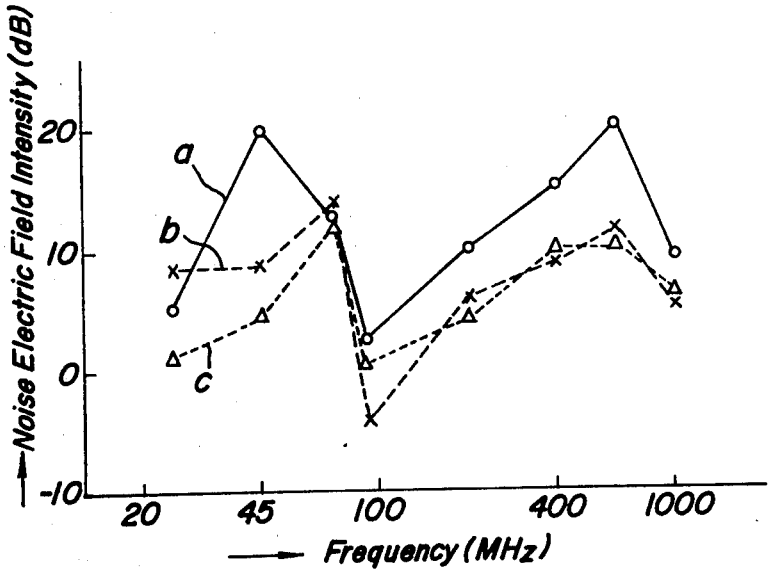
FIGS. 7 to 10 are graphs which illustrate effect of suppressing disturbance electric wave of the device according to the invention as compared with that of the conventional device.
Figure 8:
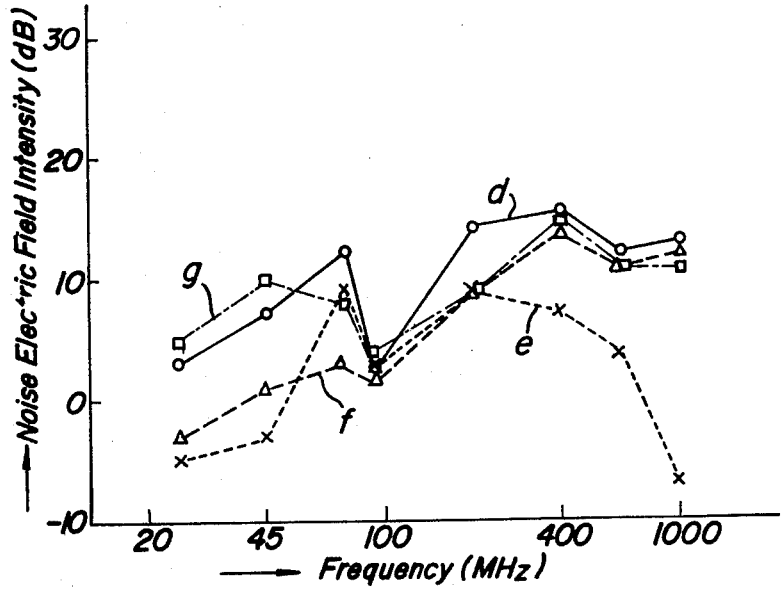

| Test Example | Type of Ignition Device | Ground Connection of Secondary Coil | Length of Ground Connection (m) | Resistance Value of Ground Connection (Ω) | Measurement Result of Noise Electric Field Intensity | Remarks |
|---|---|---|---|---|---|---|
| a | FIG. 2 | Via frame | About 0.75 | 0.1 to 0.01 | | Prior art |
| b | FIG. 5a | Via bonding strap and frame in parallel | 0.2 | 0.002 | Refer to FIG. 7 | Invention |
| c | FIG. 5b | Via bonding strap only | 0.2 | 0.002 | | |
| d | FIG. 3 | Via frame | About 0.75 | 0.050 | | Prior art |
| e | FIG. 6a | Via bonding strap only | 0.2 | 0.002 | | Invention |
| f | FIG. 6b | " | 0.2 | 0.002 | Refer to FIG. 8 | |
| g | Ground terminal E shown in FIG. 6b is connected to frame 1 only | Via frame | About 0.75 | 0.050 | | Reference Example |
| h | | Via | | 0.002 | | |

Table-continued

Figure 9:
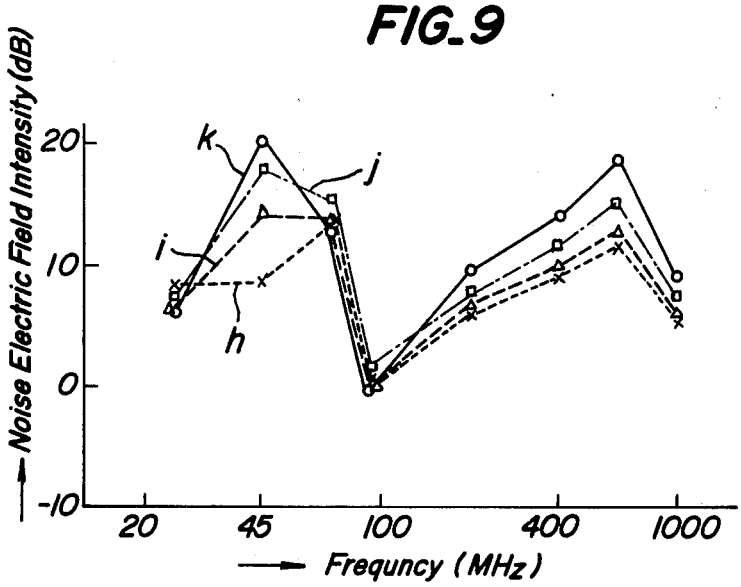
Figure 10:
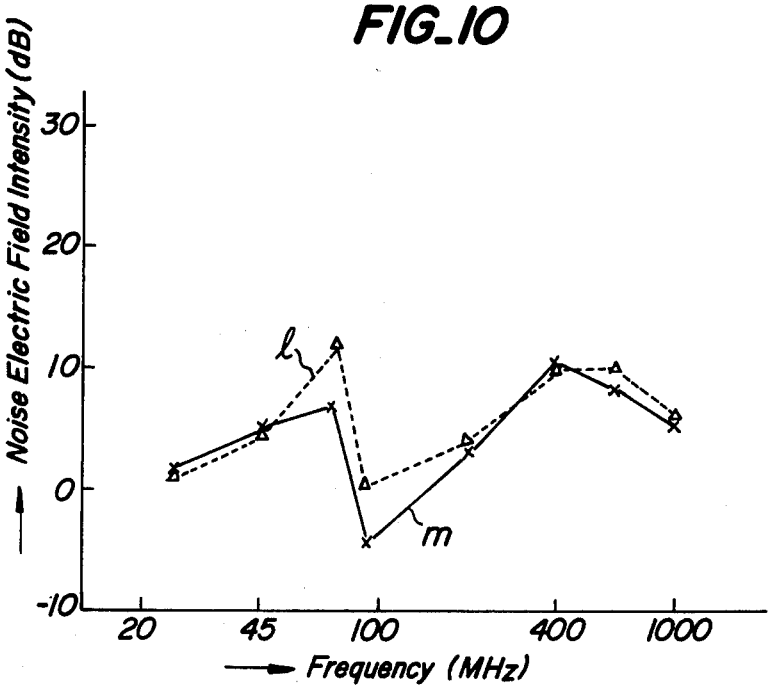

| Test Example | Type of Ignition Device | Ground Connection of Secondary Coil | Length of Ground Connection (m) | Resistance Value of Ground Connection (Ω) | Measurement Result of Noise Electric Field Intensity | Remarks |
|---|---|---|---|---|---|---|
| i | | bonding | | 0.005 | | Invention |
| j | FIG. 5a | strap and frame in | 0.2 | 0.008 | Refer to FIG. 9 | |
| k | | parallel | | 0.015 | | Reference Example |
| l | | Via bonding | | 0.002 | | |
| | FIG. 5b | strap | 0.2 | | Refer to FIG. 10 | Invention |
| m | | only | | 0.008 | | |

Note:
The resistance value of the ground connection is a resistance value between the ground terminal E or E' and the ground portion of the ignition plug.

In the experimental test examples a to m, use was made of an ignition device mounted on a motorcycle with a spark ignition type gasoline engine including a single cylinder of 175 cc and provided with an ignition plug including a resistor of 5 KΩ and an ignition plug cap including a resistor of 5 KΩ. The intensities of the noise electric field on the basis of SAE standard were measured by means of an electric meter made by Singer Co. in U.S.A. and available in market in a trade name of NM 37/57.

As seen from FIGS. 7 and 8, the test examples shown by curves b, c, e, f, in which the ground terminal of the secondary coil or the arc-suppressing condenser connected in series therewith is electrically connected through the least possibly short flexible wire to the top portion of the combustion chamber so as to substantially form the ground circuit of the secondary coil of the ignition coil are far superior in the effect of suppressing radiation disturbance electric wave to the test examples shown by curves a, d and g in which the ground terminal of the secondary coil or the terminal of the arc-suppressing condenser connected in series therewith is electrically connected through the frame to the combustion chamber in the conventional manner.

In FIG. 9, a curve k shows the result of the test example k in which the ground terminal E is connected through the frame 1 and the bonding wire 15 in parallel to the ground side of the ignition plug 4 as shown in FIG. 5*a*. In this test example k, the conductivity of the bonding wire 15 is made lower than that of the frame 1 so that substantially no ground circuit of the secondary coil 3*b* is formed by the bonding strap 15. As a result, the test example k is not sufficient to suppress the disturbance electric wave.

In FIG. 10 are shown two curves l and m illustrating noise electric field intensity in dB as function of frequency in MHz. In the case of the test examples l and m in which the ground terminal E of the ignition coil 3 is connected through the bonding strap 15 to the ground terminal of the ignition plug 4 as shown in FIG. 5*b*. In these test examples l and m, the ground circuit of the secondary coil 3*b* of the ignition coil 3 is formed of a flexible wire only. But, the effect of suppressing the disturbance electric wave of the test example m which makes use of the bonding wire having a relatively high resistivity is superior to that of the test example l which makes use of the bonding strap having a low resistivity.

As stated hereinbefore, the device according to the invention is capable of easily applying to the existing motorcycles and of simply and effectively suppressing generation of radiation disturbance electric wave which has heretofore been difficult to suppress by the prior art techniques.

What is claimed is:

1. A device for suppressing a disturbance electric wave for motorcycles, comprising a frame, an engine mounted on said frame and including a combustion chamber, an ignition plug secured to a top portion of said combustion chamber, an ignition coil secured to that portion of said frame which is located near said ignition plug and having primary and secondary coils, and a flexible wire for connecting a ground terminal of said secondary coil or a ground terminal located at that portion of said frame which is substantially the same in potential as said ground terminal of said secondary coil to said top portion of said combustion chamber of said engine.

2. The device according to claim 1, wherein said ignition coil is secured to a top portion of said frame.

3. The device according to claim 1, wherein said ground terminal of said secondary coil is connected through both said flexible wire and said frame in parallel to a ground terminal of said ignition plug.

4. The device according to claim 1, wherein said ground terminal of said secondary coil is connected through said flexible wire only to a ground terminal of said ignition plug.

5. The device according to claim 1, wherein said ground terminal of said secondary coil is connected through a condenser and said flexible wire in series to a ground terminal of said ignition plug.

6. The device according to claim 1, wherein said flexible wire is composed of a bonding strap.

7. The device according to claim 6, wherein said bonding strap is composed of a copper braid having a width of 8 mm and a length of 20 cm.

8. The device according to claim 4, wherein said flexible wire is composed of a conductor having a high resistivity.

9. The device according to claim 1, wherein the ground side of the primary coil of said ignition coil is made independent of the ground side of said secondary coil.

* * * * *